United States Patent [19]

McCartney

[11] 4,226,708

[45] Oct. 7, 1980

[54] VARIABLE WALL AND VORTEX FINDER HYDROCYCLONE CLASSIFIER

[75] Inventor: Walter T. McCartney, Uniontown, Pa.

[73] Assignee: Coal Processing Equipment, Inc., Cincinnati, Ohio

[21] Appl. No.: 771,793

[22] Filed: Feb. 24, 1977

[51] Int. Cl.[3] ..... B04C 5/14

[52] U.S. Cl. ..... 209/211; 210/512 R

[58] Field of Search ..... 209/211, 144; 210/512 R; 55/459 R, 459 D, 428, 460

[56] References Cited

U.S. PATENT DOCUMENTS

| | | | |
|---|---|---|---|
| 3,057,476 | 10/1962 | Gilbert | 209/211 |
| 3,136,723 | 6/1964 | Erwin et al. | 209/211 X |
| 3,353,673 | 11/1967 | Visman | 209/211 |
| 3,887,456 | 6/1975 | Loughner | 209/211 |
| 4,034,861 | 7/1977 | Fontein et al. | 209/211 X |

FOREIGN PATENT DOCUMENTS

| | | | |
|---|---|---|---|
| 607785 | 9/1948 | United Kingdom | 209/211 |
| 485767 | 1/1976 | U.S.S.R. | 209/144 |

*Primary Examiner*—Ralph J. Hill

*Attorney, Agent, or Firm*—Clarence A. O'Brien; Harvey B. Jacobson

[57] ABSTRACT

A housing defining a generally cylindrical chamber is provided and the chamber is closed at one end. Inlet structure is provided for admitting fluid flow suspended materials into the chamber intermediate the opposite ends thereof and in a direction extending generally tangentially of the chamber. A tubular vortex finder opens centrally into the housing through the closed end thereof and a generally frusto-conical closure wall is provided at the other end of the chamber and opens toward the closed end thereof. The apex of the closure wall defines a restricted outlet and the tubular vortex finder includes an open inlet end opening toward the outlet and spaced intermediate the closure wall and the inlet structure. The inlet structure is fixed in position longitudinally of the housing, but the frusto-conical closure wall and vortex finder are supported relative to the housing for independent adjustment relative thereto in a direction extending longitudinally of the chamber. Further, the vortex finder may be shifted independent of relative movement between the housing and the closure wall, the closure wall may be shifted independently of relative movement between the housing and the vortex finder and the housing may be shifted independent of relative movement of the closure wall and vortex finder.

7 Claims, 5 Drawing Figures

VARIABLE WALL AND VORTEX FINDER HYDROCYCLONE CLASSIFIER

BACKGROUND OF THE INVENTION

Various forms of cyclone-type classifiers have heretofore been utilized for classifying various types of fluid flow suspended materials. Some forms of cyclone-type classifiers are specifically adapted to classify materials suspended in a gas flow and other cyclone classifiers are particularly well adapted to classify materials suspended in a liquid flow.

Conventionally, cyclone classifiers include generally cylindrical housings disposed in upstanding position and closed at their lower ends by means of upwardly opening frusto-conical lower end walls including central restricted outlets. Upper portions of the housings include inlet structures for admitting fluid flow suspended materials into the interiors of the housings along paths extending generally tangentially of the chambers and tubular "vortex finders" project centrally downwardly into the interiors of the housings and terminate downwardly at a level spaced intermediate the inlet structures and the upwardly opening frusto-conical walls closing the lower ends of the housings.

In order to variably adjust the classifying capabilities of cyclone classifiers, the restricted outlets formed in the apex portions of the frusto-conical closure walls may be varied in effective cross-sectional area and may be varied in longitudinal cross-sectional profile. In addition, the vortex finders may also be adjusted longitudinally of the housings in order to further vary the classifying aspects of a cyclone-type classifier.

Various forms of cyclone classifiers of the immediately above set forth types are disclosed in U.S. Pat. Nos.: 3,057,476, 3,087,645, 3,136,723, 3,353,673, 3,455,450, 3,887,456, 3,902,601 and 3,926,787.

BRIEF DESCRIPTION OF THE INVENTION

The cyclone classifier of the instant invention includes all of the above referred aspects of to prior known classifiers and in addition is constructed in a manner whereby the effective cross-sectional area and longitudinal cross-sectional profile of the outlet for the classifier may be quickly and inexpensively changed. Also, the cyclone classifier of the instant invention is constructed in a manner whereby not only may the vortex finder be adjusted longitudinally of the cylindrical chamber of the classifier, but the frusto-conical closure wall of the bottom end of the cyclone classifier housing may be adjusted relative to the housing and the vortex finder. Further, the housing may be longitudinally shifted relative to the closure wall and the vortex finder, independent of adjustment of the closure wall relative to the vortex finder.

By making adjustments in one or more of the above areas of the cyclone classifier, the latter may be tailored for efficient classification of various mixtures of fluid flow suspended materials.

Although the classifier of the instant invention has been specifically designed for classifying various forms of coal refuse containing various percentages of ash and sulfur, it is to be noted that the various adjustments of the classifier also adapt it for more efficient classifications of other materials.

The main object of this invention is to provide a cyclone classifier which may be adjusted as to its ability to efficiently classify various mixtures of fluid flow suspended materials.

Another object of this invention is to provide a cyclone classifier specifically adapted to separate coal from refuse and which will eliminate the need for prescreening, vibrating tables or other powered equipment.

Yet another important object of this invention is to provide a hydrocyclone classifier which will also eliminate problems associated with flotation separation of the free pyrites and oxidized coal, and allow separation at high gravities not obtainable in heavy, medium cyclones due to the viscosity of the heavy medium.

Another object of this invention is to provide a hydrocyclone classifier which will be capable of being tailored to a specific application.

A final object of this invention to be specifically enumerated herein is to provide a hydrocyclone classifier which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
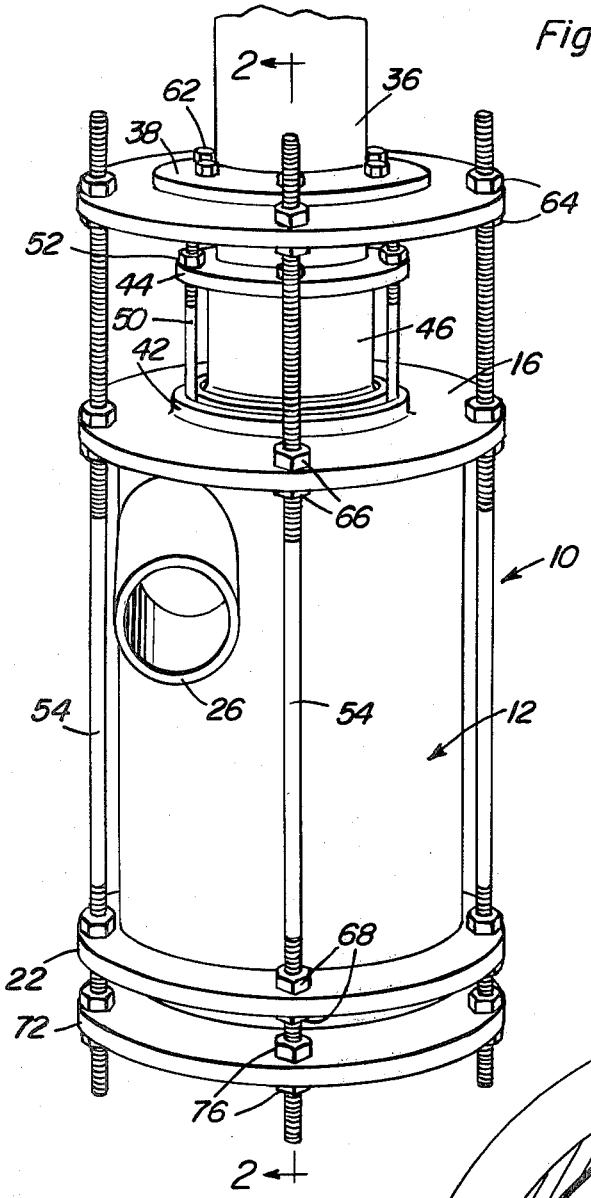
FIG. 1 is a perspective view of the classifier of the instant invention.
Figure 4:
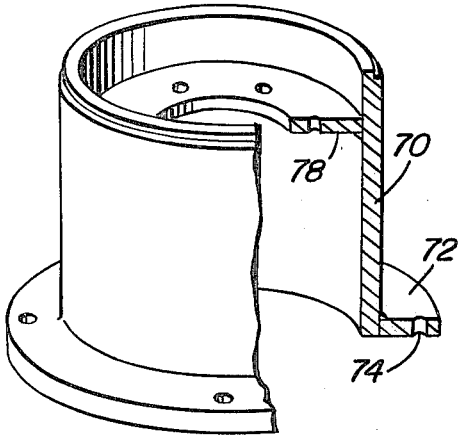
FIG. 4 is a perspective view of the support sleeve for the lower bowl of the classifier with parts thereof broken away and illustrated in vertical section.
Figure 3:
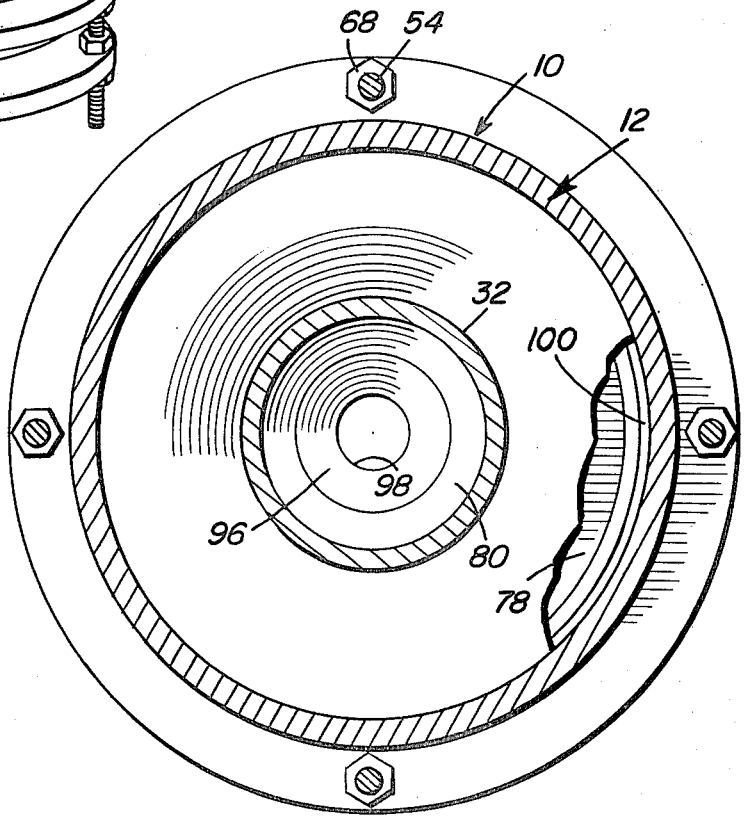
FIG. 3 is a horizontal, sectional view taken substantially upon the plane indicate by the section line 3—3 of FIG. 2.

Referring now more specifically to the drawings, the numeral 10 generally designates the hydrocyclone classifier of the instant invention. The classifier 10 includes a cylindrical housing referring to in general by the reference numeral 12 defining a hollow cylindrical body 14 disposed in upstanding position. The upper end of the body 14 is closed by means of an upper end wall 16 secured over the upper end of the body 14 by welding and the end wall 16 is provided with a central aperture 18.

The end wall 16 projects outwardly beyond the outer surfaces of the body 14 and is provided with a plurality of bores 20 formed therethrough at points spaced about the outer periphery of the end wall 16.

The lower end of the body 14 includes an annular support flange 22 supported therefrom by welding and the support flange 22 includes an outer periphery which projects outwardly of the body 14 and is provided with circumferentially spaced bores 24 registered with the bores 20. The inner periphery of the annular flange 22 is slightly larger in diameter than the inside diameter of the cylindrical body 14.

The body 14 includes a laterally outwardly opening inlet neck 26 adjacent its upper end and the inlet neck 26 opens into the chamber 28 defined in the interior of the housing 12 along a path generally tangential to the chamber 28. Further, the lower end portion 30 of a cylindrical vortex finder 32 projects downwardly through the aperture 18 to a level spaced below the inlet 26 and the open lower end 34 of the vortex finder defines an inlet opening into the vortex finder 32 from the interior of the housing 12. The upper end portion 36 of the vortex finder 32 projects upwardly above the end wall 16 and has an annular mounting flange 38 secured thereto by welding.

A modified Dresser coupling referred to in general by the reference numeral 40 is supported from and above the end wall 16 and forms a fluid tight seal between the end wall 16 and the outer surfaces of the vortex finder 32. The Dresser coupling 40 includes an annular base 42 secured to the upper surface of the end wall 16 about the aperture 18 and an upper follower 44 with a sleeve 46 disposed about the upper end portion 36 of the vortex finder 32 between the annular base 42 and the follower 44. Annular seals 48 are axially compressively engaged between the opposite ends of the sleeve 46 and the base 42 and the follower 44 and clamp bolts 50 secured to the annular base 42 at points spaced thereabout and slidingly received through corresponding portions of the follower 44 have nuts 52 threadedly engaged therewith whereby the sealing action of the seals 48 with the outer surface of the upper end portion 36 of the slidable vortex finder 32 may be adjusted.

A plurality of support rods 54 are passed through corresponding pairs of bores 20 and 24 and an annular support plate 56 slidingly receives the upper end portion 36 of the vortex finder 32 therethrough and the plate 56 includes peripherally spaced bores 60 through which the upper ends of the rods 54 extend and the support plate 56 is secured to the flange 38 by fasteners 62. Still further, nuts 64 are threadedly engaged with the rods 54 above and below the support plate 56, nuts 66 are threadedly engaged with the rods 54 above and below the end walls 16 and nuts 68 are threadedly engage with the rods 54 above and below the flange 22.

A support and adjusting sleeve 70 disposed in upstanding position has its upper end slidingly telescoped upwardly into the lower end of the body 14 and includes an annular flange 72 secured about its lower end portion provided with spaced bores 74 registered with the bores 20, 24 and 60. The lower ends of the rods 54 are received downwardly through the bores 74 and threaded nuts 76 are threadedly engaged with the rods 54 above and below the flange 72. The sleeve 70 includes an internal annular support flange 78 welded in position in the interior thereof a spaced distance below the upper end of the sleeve 70 and a bowl 80 of generally frusto-conical configuration is slidingly disposed within the lower end portion of the body 14 with its outer periphery resting upon the upper end of the sleeve 70. The bowl 80 includes a downwardly facing shoulder 82 which abuts against the upper surface of the flange 78 and is secured to the latter by means of fasteners 90. A downwardly tapering hollow insert holder 92 is secured against the underside of the flange 78 by means of the fasteners 90 and includes a conical passage 94 therein in which an orifice insert 96 is seated, the orifice insert 96 being frusto-conical in configuration and having the upper diameter end thereof abutted against the underside of the bowl 80.

The bowl 80 and orifice insert 96 define three conical sections A, B, and C of the bowl 80 opening downwardly to the final lower outlet 98 of the orifice insert 96. The outer peripheries of the bowl 80 and the upper end of the sleeve 70 are relieved to receive a seal ring 100 therebetween. Further, the orifice insert 96 may be replaced by removing the holder 92, placing a substitute orifice insert 96 within the holder 92, and resecuring the holder 92 in position.

In operation, a mixture of fluid flow suspended material is admitted into the housing 12 through the inlet 26 and a vortex flow is formed within the housing 12 about the vortex finder 32 with the lighter materials being discharged upwardly from the housing 12 through the vortex finder 32 and the heavier refuse, fine as well as course, is discharged through the outlet 98.

However, various adjustments may be made in the cyclone classifier 10 in order to vary the classifying operations performed thereby. Initially, it is pointed out that the nature of a cyclone classifier is such that a 100% efficiency of separation of any two materials is difficult, if not impossible, to achieve. This is especially true if the different materials have specific gravities which are close to each other. Conversely, even if one type of material was pumped into a cyclone classifier, some separation would still occur through the orifice or outlet 98 and the vortex finder 32, depending upon the diameter of the orifice and its distance from the vortex finder opening 34.

In a cyclone classifier having a constant orifice opening 98 and a constant cylinder wall length, adjusting the distance D2 between the vortex finder and the bowl 80 will only vary the percentage of the lighter specific gravity materials which will pass through the vortex finder. Obviously, the greater the distance D2, the more constant in specific gravity will be the material that passes through the vortex finder. However, the purer the material which is drawn through the vortex finder, the greater will be the loss of some of the desired materials passing through the orifice 98.

It is, therefore, apparent that a critical point occurs, as the vortex finder is raised in relation to the bowl 80, where a compromise is achieved between the consistency of the specific gravity of the desired product passing through the vortex finder and the acceptable amount of loss of this product which passes through the orifice 98 together with the refuse material.

By varying the length of the cylinder wall of a cyclone classifier classifying certain types of coal, while the vortex finder is left at a constant position and thereby changing the relationship not only between the bowl 80 and the vortex finder 32 but also the distance between the bowl 80 and the inlet 26, the percentage of recovery of lighter materials will be increased. This adjustment also reaches a critical point by which lowering the bowl 80 further in relation to the inlet 26 and the vortex finder 32 will begin to produce poorer results.

Figure 2:
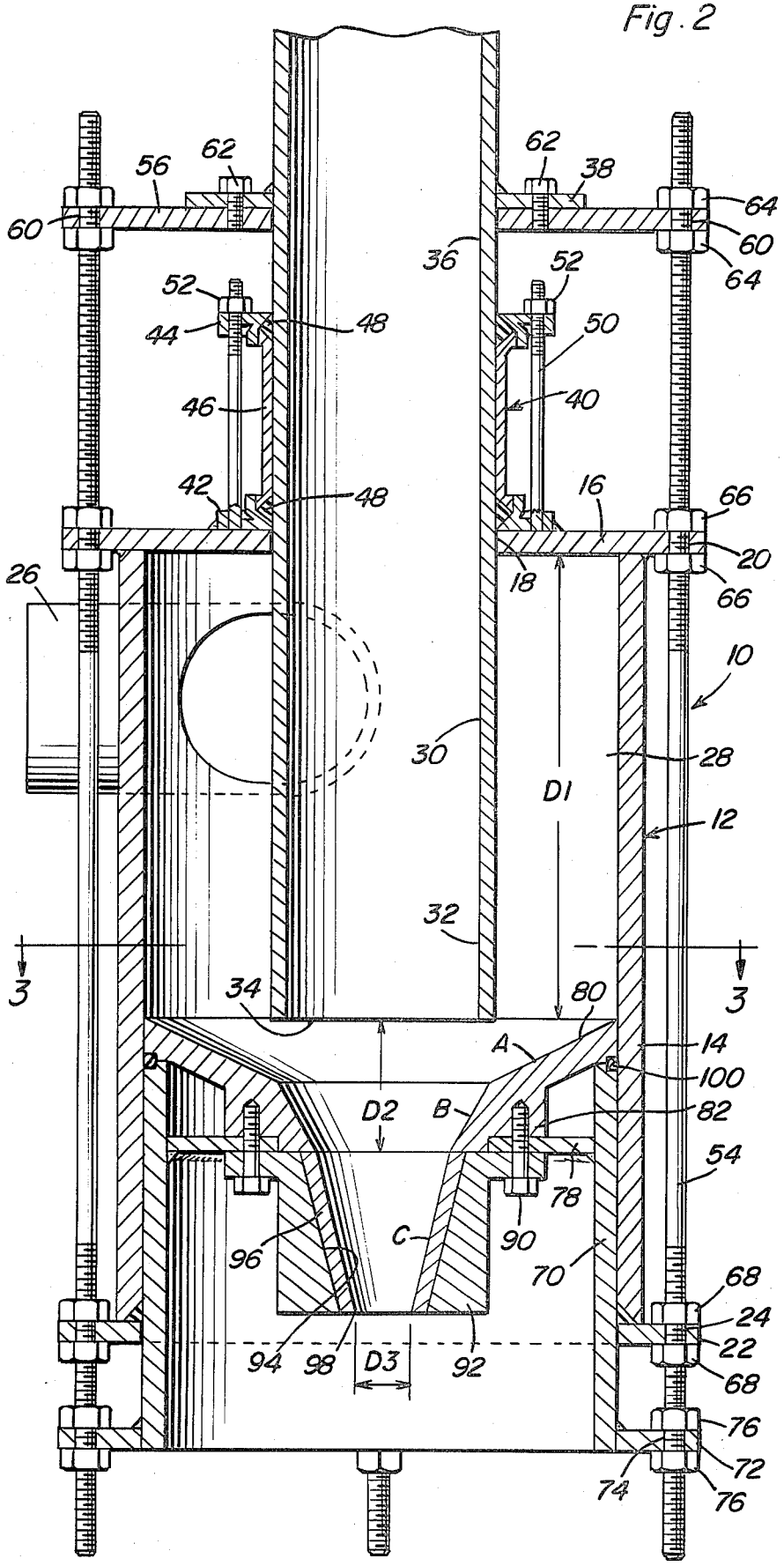
FIG. 2 is an enlarged, longitudinal, vertical, sectional view taken substantially upon the plane indicated by the section line 2—2 of FIG. 1.

In addition, once the desired distance D2 is achieved, it then becomes important to diminish the percentage of loss of the lowest specific gravity material passing through the orifice 98. This can be accomplished by increasing the effective length of the chamber 28 or the distance D1 in FIG. 2. The longer the cylinder wall, the greater will be the period of time for material to classify or separate and the greater will be the efficiency or percentage recovery up to a critical point. For any given mixture entering the chamber 28, lengthening the cylinder wall beyond a certain critical point will begin to produce poorer results until a levelling-off point is reached.

It should be noted, however, that whenever the mixture or type of material entering the vessel is changed, a different setting for both the vortex finder 32 and the bowl 80 becomes its critical point. As an example, a coal having a large number of "fines", or in which the foreign particles have a specific gravity close to the small coal particles, will require a longer period of time to remain in the vessel to classify than would be required for a mixture where the specific gravity of the non-coal particles is much higher than the specific gravity of the coal, even if the percentage of non-coal particles or ash in both types of mixture were the same.

Figure 5:
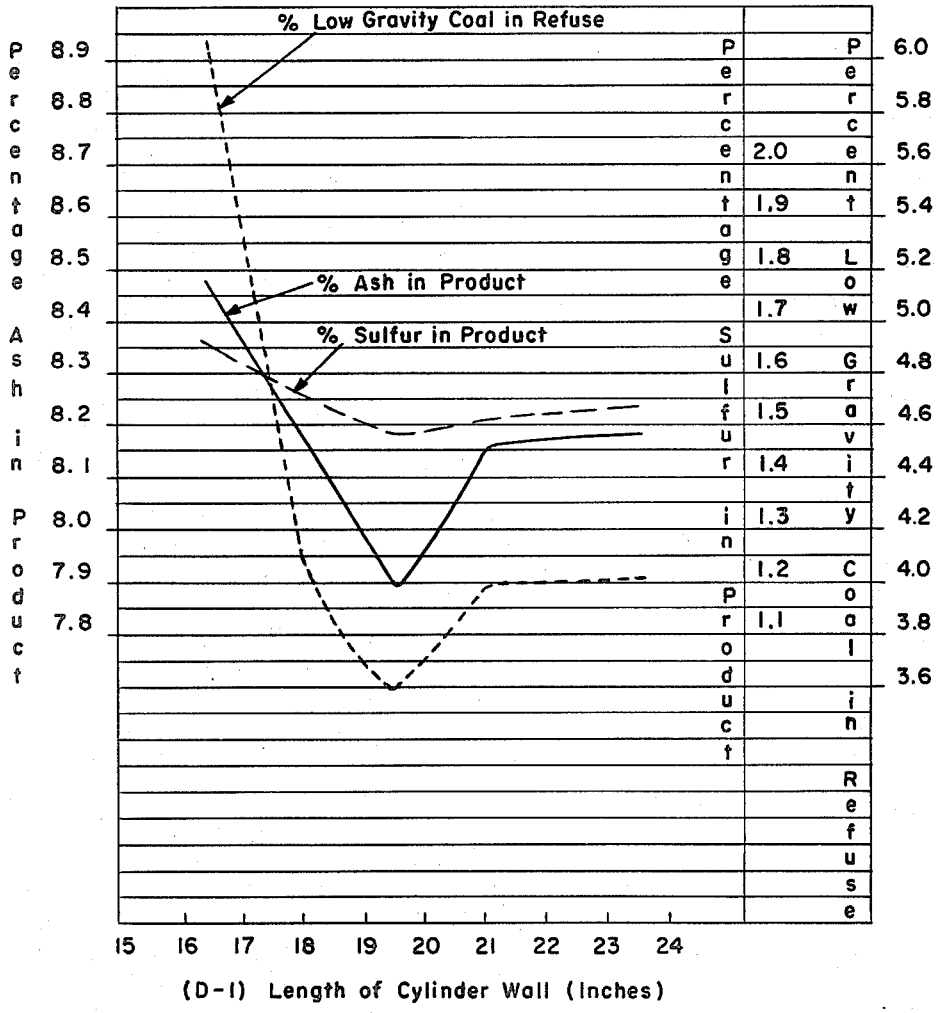
FIG. 5 is a graph illustrating the manner in which minimum percent of ash and sulfur in product and minimum content of low gravity coal is achieved in refuse as a result of proper use of the instant invention.

Increasing the length of the chamber wall D1 after the optimum distance between the vortex finder 32 and the bowl 80 D2 is achieved, makes it possible to increase the length of time for the particles to separate. The net result being that a greater percentage of separation of the lowest specific gravity particles will then take place. In the graph of FIG. 5 is illustrated the net effect on ash, sulfur and refuse that have been obtained in a test cyclone classifier where the length D1 has been adjusted to its optimum position after maintaining the critical position of the vortex finder 32.

The input coal in the test analysis, demonstrated by the graph of FIG. 5, contained 16% ash and 2.85% sulfur. The critical distance D2 of the vortex finder to the bowl 80 for this mixture was determined to be 3.5 inches and was maintained throughout the experiment.

As can be seen from the graph of FIG. 5, the critical distance D1 for the particular mixture used in this experiment was determined to be 19.5 inches. As the bowl 80 was lowered, thereby increasing the length of the cylinder wall D1, the ash content in the product decreased from 8.45% to 7.9% and the sulfur decreased from 1.65% to 1.48%, even though the distance D2, between the vortex finder 32 and the bowl 80 remained constant.

As the bowl was further lowered, thereby producing a cylinder wall greater than 19.5 inches, the percentage of sulfur and ash in the product began to increase until the cylinder wall length D1 was adjusted in excess of 21 inches. At this point, increasing the length of the cylinder wall further had minimal effects on the product. As an additional indication of the efficiency of the classification which can be achieved by changing the length of the cylinder wall D1, tests were also taken to determine the amount of lowest specific gravity coal in the refuse passing through the orifice.

Again, it was determined that the point where the lowest percentage of coal appeared in the refuse (3.6%) occurred when the length of the cylinder wall D1 was adjusted for this particular mixture to 19.5 inches. Decreasing the length of the cylinder wall to 16.5 inches produced a high percentage of coal in the refuse, 6%. Similarly, increasing the length of the cylinder wall beyond 19.5 inches to 21 inches increased the coal in the refuse to 4% at which point further lengthening of the cylinder wall had little additional effect on the refuse.

The same experiment was conducted a number of times on various types of coal with similar results being obtained. However, each time the type of coal was changed, the optimum setting for the bowl to establish the length of the cylinder wall D1 was different as well as the critical distance D2 between the bowl 80 and the vortex finder 32. In cases where the content of the material varies greatly, the size of the orifice 98 must then also be changed. In this instance, a radical change was necessary to establish both D2 the distance between the vortex finder 34 and the bowl 80 and then D1, the length of the cylinder wall in order to produce the optimum result possible.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be restored to, falling within the scope of the invention.

What is claimed as new is as follows:

1. A cyclone classifier including a housing defining a generally cylindrical chamber, means for admitting fluid flow suspended materials into said chamber adjacent one end thereof and in a direction extending generally tangentially of said chamber, an elongated hollow vortex finder centrally disposed in said chamber adjacent said one end thereof and shiftable longitudinally of said chamber, said vortex finder opening into the chamber toward the other end thereof, inwardly opening generally frusto-conical wall means disposed in and closing the other end of said chamber, said frusto-conical wall means opening inwardly toward and being shiftable toward and away from said one end of said chamber, the apex of said wall means including means defining a restricted outlet, and adjustment means operatively connected between said frusto-conical wall means and said vortex finder and between the combination including said frusto-conical wall means and said vortex finder and said housing for adjustable relative shifting between said frusto-conical wall means and said vortex finder longitudinally of said chamber and adjustable relative shifting between said combination and said housing longitudinally of said chamber independent of relative shifting between said frusto-conical wall means and said vortex finder.

2. The combination of claim 1, wherein said adjustment means includes means for adjusting said vortex finder relative to said housing longitudinally of said chamber independent of adjustment of said frusto-conical wall means and, selectively, simultaneous adjustment of said vortex finder and frusto-conical wall means relative to said housing.

3. The combination of claim 1 wherein said adjustment means includes means for adjusting said frusto-conical wall means relative to said housing independent of adjustment of said vortex finder relative to said housing and, selectively, simultaneous adjustment of said frusto-conical wall means and vortex finder relative to said housing.

4. A cyclone classifier including an elongated housing defining a generally cylindrical chamber, closed at one end, inlet means for admitting fluid flow suspended materials into said chamber intermediate the opposite ends thereof and in a direction extending generally tangentially of said chamber, an elongated tubular vortex finder opening centrally into said housing through said one end and shiftable longitudinally of said housing, generally frusto-conical closure wall means disposed in, shiftable longitudinally along and closing the other end of said chamber and opening toward said one end thereof, said vortex finder including an open inlet end opening toward said closure wall, the apex of said wall means including means defining a restricted outlet, said open inlet end being spaced intermediate said outlet and inlet means longitudinally of said chamber, and adjustment means operatively connected between said closure wall means and said vortex finder and between the combination including said closure wall means and said vortex finder and said housing for adjustable relative shifting between said closure wall means and said vortex finder longitudinally of said chamber and adjustable relative shifting between said combination and said housing longitudinally of said chamber independent of relative shifting between said closure wall means and said vortex finder.

5. The combination of claim 4 wherein said adjustment means includes means operative to adjust said closure wall means relative to said housing independent of adjustment of said vortex finder relative to said housing and, selectively, simultaneous adjustment of said closure wall means and vortex finder relative to said housing.

6. The combination of claim 4 wherein said adjustment means includes means operative to adjustably shift said vortex finder, longitudinally of said chamber, relative to said housing independent of adjustment of said closing wall means relative to said housing and, selectively, simultaneous adjustment of said closure wall means and vortex finder relative to said housing.

7. The combination of claim 4 wherein said means defining a restricted outlet comprises a replaceable outlet sleeve removably supported from said closure means.

* * * * *